United States Patent [19]

Holz et al.

[11] 4,394,217

[45] Jul. 19, 1983

[54] APPARATUS FOR SERVICING COKE OVENS

[75] Inventors: Wilhelm Holz, Gelsenkirchen; Helmut Lukaszewicz, Bottrop; Karl Gregor, Bochum, all of Fed. Rep. of Germany

[73] Assignees: Ruhrkohle Aktiengesellschaft, Essen; Gewerkschaft Schalker Eisenhütte, Gelsenkirchen, both of Fed. Rep. of Germany

[21] Appl. No.: 248,452

[22] Filed: Mar. 27, 1981

[30] Foreign Application Priority Data

Mar. 27, 1980 [DE] Fed. Rep. of Germany ..... 3011781

[51] Int. Cl.[3] ..... C10B 33/06; C10B 39/04; C10B 39/12; C10B 43/06

[52] U.S. Cl. ..... 202/227; 202/230; 202/241; 202/263; 202/270; 414/211; 414/215

[58] Field of Search ..... 202/227, 241, 262, 263, 202/270, 230; 15/93 A; 414/209-212, 214, 215; 201/1

[56] References Cited

U.S. PATENT DOCUMENTS

| | | | |
|---|---|---|---|
| 1,378,782 | 5/1921 | Griffin | 414/214 |
| 1,480,160 | 1/1924 | Ferguson | 414/211 |
| 2,894,649 | 7/1959 | Malkomes . | |
| 3,480,514 | 11/1969 | Kinzler et al. | 202/270 |
| 3,501,380 | 3/1970 | Perch | 201/1 |
| 3,955,232 | 5/1976 | Konno | 15/93 A |
| 4,077,848 | 3/1978 | Gawer et al. | 202/270 |
| 4,135,948 | 1/1979 | Mertens et al. | 15/93 A |
| 4,153,515 | 5/1979 | Gregor et al. | 202/241 |
| 4,213,828 | 7/1980 | Calderon | 202/227 |
| 4,253,915 | 3/1981 | Goossens et al. | 202/270 |

FOREIGN PATENT DOCUMENTS

| | | | |
|---|---|---|---|
| 807091 | 6/1951 | Fed. Rep. of Germany . | |
| 1101356 | 3/1961 | Fed. Rep. of Germany . | |
| 1103887 | 4/1961 | Fed. Rep. of Germany . | |
| 2641382 | 3/1977 | Fed. Rep. of Germany . | |
| 2633331 | 10/1978 | Fed. Rep. of Germany . | |
| 552686 | 4/1943 | United Kingdom . | |
| 755330 | 8/1980 | U.S.S.R. | 15/93 A |
| 765336 | 9/1980 | U.S.S.R. | 202/262 |

*Primary Examiner*—Bradley Garris

*Attorney, Agent, or Firm*—Andrus, Sceales, Starke & Sawall

[57] ABSTRACT

Apparatus for servicing coke ovens has a framework movable along the coke oven battery. A horizontally rotatable and vertically pivotable boom has one end mounted on the gantry and a coke oven work tool on the other. The framework includes a coke quenching apparatus and conveying equipment.

13 Claims, 6 Drawing Figures

APPARATUS FOR SERVICING COKE OVENS

BACKGROUND OF THE INVENTION

The invention relates to a device for servicing coke ovens formed of a framework movable along a coke oven battery and a boom machine movable transverse to the framework. The horizontally rotatable and vertically pivotable boom of the boom machine is provided with cooling channels and has, on its free end, a connection head for preferably a plurality of work implements, including at least a combination of a scoop and scraper apparatus for the removal of coke from each oven chamber.

The invention refers, in particular, to those service processes in the coke oven, that must be carried out, in modern horizontal chamber ovens, above and beyond the systematic charging and emptying of the oven chambers. The invention is particularly applicable to large capacity ovens, that have approximately 8 meter chamber height and approximately 16 meter chamber length and attain a volume of 35–40 tons. However, the invention is also applicable to coke ovens having heights that attain magnitudes of about 4 meters and lengths of 11 meters. In large capacity ovens, particularly great forces are introduced in the chamber packing from the coke pushing machine, that stress the chamber walls of the large capacity oven during the expulsion of the chamber packing to a greater extent than the chamber walls of smaller designs. This results in the necessary, and with large capacity ovens particularly intensive, maintenance work on the top ends, the oven anchoring, the chamber walls, and the chamber closing apparatus, which is essential for the preservation of the availability, and therewith the efficiency, of the installation. In addition to that, a continuous monitoring of the chamber walls, the oven ceiling, and the oven floor is essential for the timely detection and elimination of damage, as well as a timely removal of graphite deposits on the chamber walls in the region of the change point, the filling holes, the standpipe openings and the standpipes. Such removal is necessary, because such graphite deposits, if not periodically removed, lead to serious operating trouble.

In addition to the foregoing with unusual operating conditions, such as fluctuations of the quality of the coal charge, disturbances in the heating, or with leakage in the chamber frames and the chamber closures can come difficulties with coke expulsion through packing of the coking mass, so that damages to the oven walls through lateral pressures are not precluded.

Further damages in mechanical apparatuses, chamber frames, and anchor supports can develop when for the named reasons, the process of the coke expulsion must be interrupted. The incandescent coal is then partially stuck fast in the coke stream passage trough and from there must, with difficult working, be manually removed. The rest of the coke still remaining in the oven chamber, is in such cases, likewise with bars and scrapers removed sufficiently far out of the chamber that the residuum can be pressed out of the oven chamber with the coke pushing machine. In extreme cases the entire oven chamber must be scraped empty.

The physical exertions of the service personnel connected with the maintenance work, in particular, those appearing in cases of interruption are not longer reasonable. Beyond that, a considerable danger of accident arises through the great height of the subsidable incandescent coke pieces. Although one has already realized for sometime an almost completely mechanical servicing of the coke oven corresponding to the high state of the art of coke oven construction, there has been no success in attaining a comparable state with the previously described work.

DESCRIPTION OF THE PRIOR ART

To be sure, an apparatus is already known for the removal of coke out of the oven chambers (DE-PS 807,091), which should facilitate the hand labor connected with the scraping out of the packed coking mass from the oven chamber from the coke side. For that purpose a gantry-like framework is provided that is movable on a track, the rails of which are fixed on the main passage and particularly on foundations adjacent the quenching car track. The upper part serves for the support of a scraper conveyor slidable in the oven chamber and also vertically pivotable. The movable part of the scraper conveyor is provided with scoops for the scraping out of the coke from the oven chamber. A short conveyor is mounted on it as a conveying means that takes the scraped out coke and discharges it in the quenching car, that for the purpose must be held ready beneath the framework.

A device does, on the one hand, not take into sufficient consideration the practical requirements that must be borne in mind with a packed coking mass in the oven chamber. On the one hand namely, the previously known apparatus can work only the coking mass packed in the coke side and that only with release of the oven floor because the danger of injury arising from the scoops of the scraper conveyor. That has the disadvantage that on the machine side, the packed coking means cannot be leveled for the pressing rod of the expulsion machine, so that a new attempt at pressing out proves unavailing on account of the tilting of the push rod and the thereon tangential blocking of the pusher rod drive. Moreover with oven floors that are not freely loaded, the danger exists on the coke side that the coking mass is stuck anew in the oven chamber, in which case the attempt at pressing out is repeated. Beyond that, the heat of the coking mass stresses, during the entire working time that is necessary for the elimination of the oven disturbance, the apparatus itself and the coking mass carrying car, so that the increased damage on this apparatus must be seriously considered.

With a frequent disturbance of the oven operation, the coke charge, additionally, sits not only in the oven chamber, but also in the coking mass carrying car. This condition is particularly critical in the coking mass carrying car, because through the oxygen of the air and the thermally induced air current, the coke begins to burn and the car can be destroyed through heating effects in a short time. The scraper conveyor of the previously known apparatus requires that one initially move the coking mass carrying car to the side. This is, however, only possible if it thereby succeeds in breaking away the coking mass. This fails mainly however in the two weak output power of the carrying car. The incandescent coal lies then not only in the coking mass guide ways, but also falls between the anchor supports and the machine running gear. Through that arises the additional injury to the anchor supports and the main passageway deck. If the car is successfully moved, the incandescent coke must be manually removed out of the coking mass transport car. This work is dangerous and cannot be carried out in a sufficiently short time. An injury of the machine is thus, as a rule, unavoidable.

Also not of assistance is a further previously known apparatus (DE-PS 11 01 356), from which the invention proceeds, because this apparatus considers not only the removal of packed coke in the oven chamber, but also work apparatus for the carrying out of maintenance work that requires spraying, grinding, welding, or the like. The framework of this apparatus is movable on the main passage of the coke side and braceable with anchor supports. It has additional framework supports that support the platform formed from the framework on portions of the main passage. The combination of a scoop and a scraper apparatus as charging apparatus renders possible the free loading of the oven floor from the coke side out. For the elimination of the described oven disturbances, this apparatus is however little suitable, because the processing of the coking mass in the oven chamber from the machine side is almost impossible due to the problem of a danger free disposal of the incandescent coke pushed out of the oven chamber. To be sure, the apparatus is movable; however, it must therefor use the main passageway, that is suitable only in a limited range for the absorption of static and dynamic loads of such an apparatus. These considerations arise also to negate the use of the anchor supports for the reinforcement of the apparatus.

SUMMARY OF THE INVENTION

The invention has as its object to provide an apparatus of the known previously provided type, which renders possible working of the coking mass from both sides of the chamber, as from the machine and the coke sides, as well as moreover a danger free disposal of the coke delivered out of the oven chamber.

This object is attained according to the invention in that the framework formed as a gantry is provided in its vertical supports with controllable and individually driven running gear for the trackless operation in the track bodies of the coke and the machine sides and, in that a coke quenching apparatus has an adjustable feeding conveyor reaching to a respective oven floor, and in that a receiving apparatus for the quenched coke has a discharge conveyor.

The invention renders possible, in spite of the greatly differing gauge of the track of the coke pushing machine with respect to the track of the quenching cars, the travel in these rail areas on both sides of the battery. Thus the machine can be employed as required on each side of the coke oven battery, in particular, for the elimination of operating disturbances. The combination of the scoop and scraper device can also be used for the production of a suitable working surface for the pressing out piston on the coking mass packed in the chamber. Moreover, the machine, for the elimination of operating disturbances, is provided with a special undertaking and processing device for the coke charge so that after removal of an operating disturbance, the normal oven operation can be immediately restarted.

This new machine replaces the devices hitherto found in use for the scraping out of the coke charge over the oven floor and for the removal of graphite deposits, for example, in the form of air pressure sprays and mechanical reamers, in particular in the form of rods and air lances. The present invention employs a boom machine, with which the necessary working processes are mechanically carried out from a control stand. Thus, the heating effects on service personnel and the possibility of danger hitherto connected with this work are avoided, which effects and dangers heretofore through downwardly precipitating graphite slabs and large spark showers impair the manual work and make it generally impossible with large volume ovens.

The machine according to the invention is, on the basis of its mobility, in a condition to occupy a favorable position for the respectively necessary work processes on the machine and coke side of the battery independent of the energy grid, without endangering its stability. Therefore the boom of the machine can also serve as a carrier for a repair platform, that avoids the expensive movement and securing of the work platform that must otherwise customarily be employed for the inspection and adjustment of the transverse anchoring, chamber frames, and chamber closures of the coke oven battery in the confines of the periodic maintenance and routine repair work. One can also use the boom as a lifting appliance.

Preferably, and according to a further feature of the invention, therefore, the new apparatus is purposely so constructed that the gantry has an upper platform, under which are arranged the rails for a guided car. On the car are located the ring mount, the pivot drive of the boom, and a control stand surrounded by a cab. Beneath the platform an intermediate gallery is provided in the gantry, that serves for the placing of a water filled coke receiving container with a spray hood which grinds the discharging coke between conveyors, whereby the discharge conveyor is arranged beneath the coke receiving container.

With this exemplary embodiment of the invention, one can, with different, hereinafter further explained, individually illustrated working processes serving for the elimination of operating disturbances with the pressing of the coke out of an oven chamber, accommodate the associated subsiding incandescent coke under the boom machine and thereby simultaneously separate it, so that a danger free transport is possible. The possibility of the boom permits reaching each part of the half oven chamber including the oven walls from the coke side or the machine side, in which the movement of the machine on the gantry and the movement on the boom of the rotating mount are taken advantage of and combined with each other.

According to a further feature of the invention a swivel drive acting on the boom and a horizontal link are arranged on the rotating mount of the boom machine, which mount accommodates the rigid boom formed out of a plurality of sections and containing a forward cooling means and rearward cooling means. On the rigid boom; in the area of the rotating link of the boom's swivel drive, is fastened a drive for the supply of movement energy for a combination scoop and scraper device mountable on the connection head through a further horizontal link.

With this exemplary embodiment of the invention one can through a simple thrust movement of this construction element use it as scoop, as well as a scraper device. The scoop serves thus to pick up the coke from the oven floor and to avoid that it, as heretofore, is scraped out off of the oven floor. Thus the floor of the oven and also the lower portions of the oven walls are spared. For particularly packed coke, the possibility of equipping the boom with a breaking hook or a spike exists. The boom and also the thrust rod displaced for the actuation of the scoop on the boom are continuously cooled through a forced circulation with integral cooling, so that the functional efficiency of the machine is not impaired through the effects of heat. The employment of the new device, equally as for the individual processes, permits therethrough essential shortening of the required work times.

BRIEF DESCRIPTION OF THE DRAWING

The details, further features, and other advantages of the invention will be apparent from the following description of an exemplary embodiment with the aid of the figures of the drawings which shows in.

DESCRIPTION OF THE PREFERRED EMBODIMENT

Figure 1:
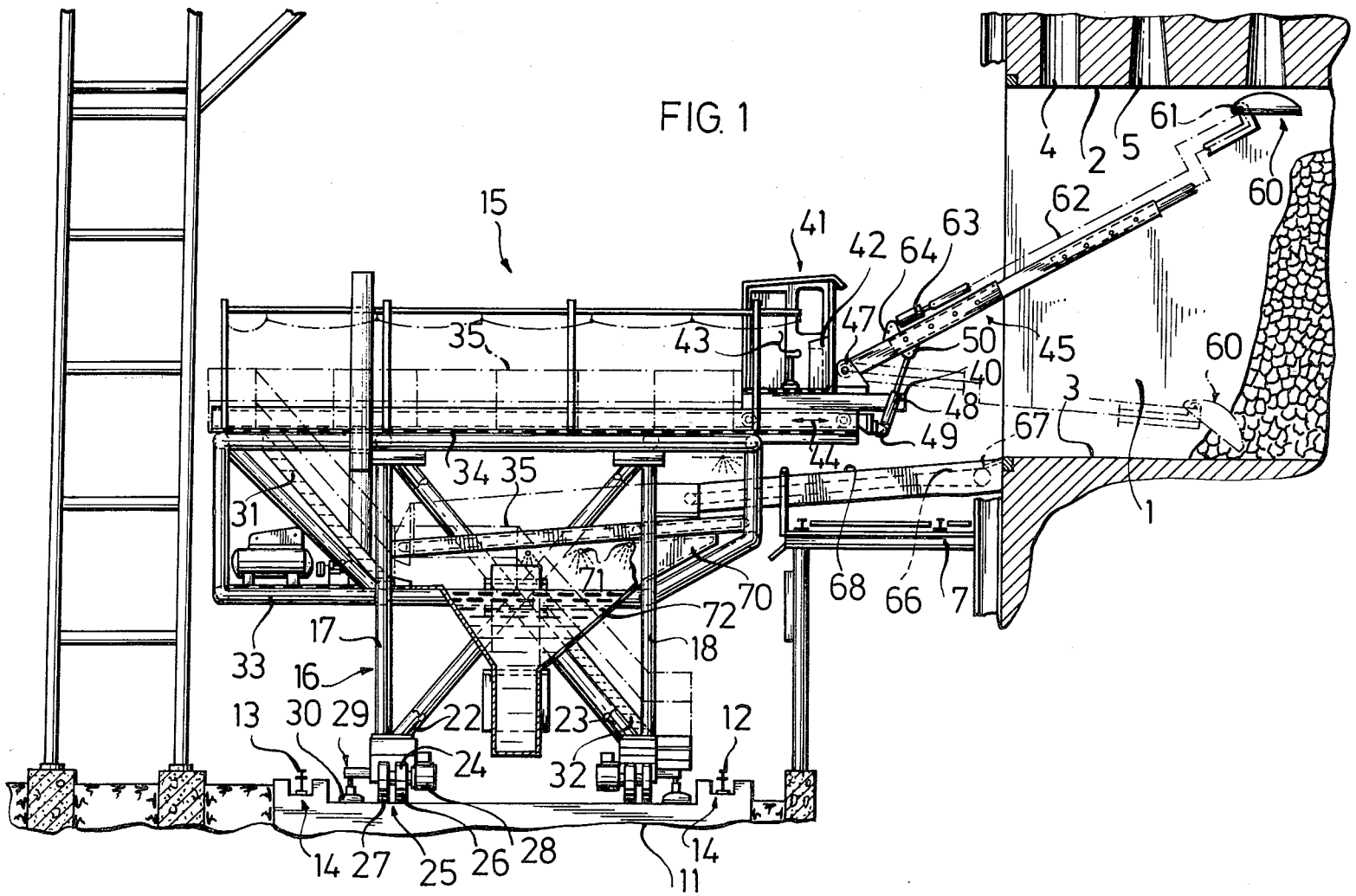
FIG. 1 a front view of a device according to the invention with the removal of coke charge from an oven chamber by means of the shovel and scraper combination.
Figure 2:
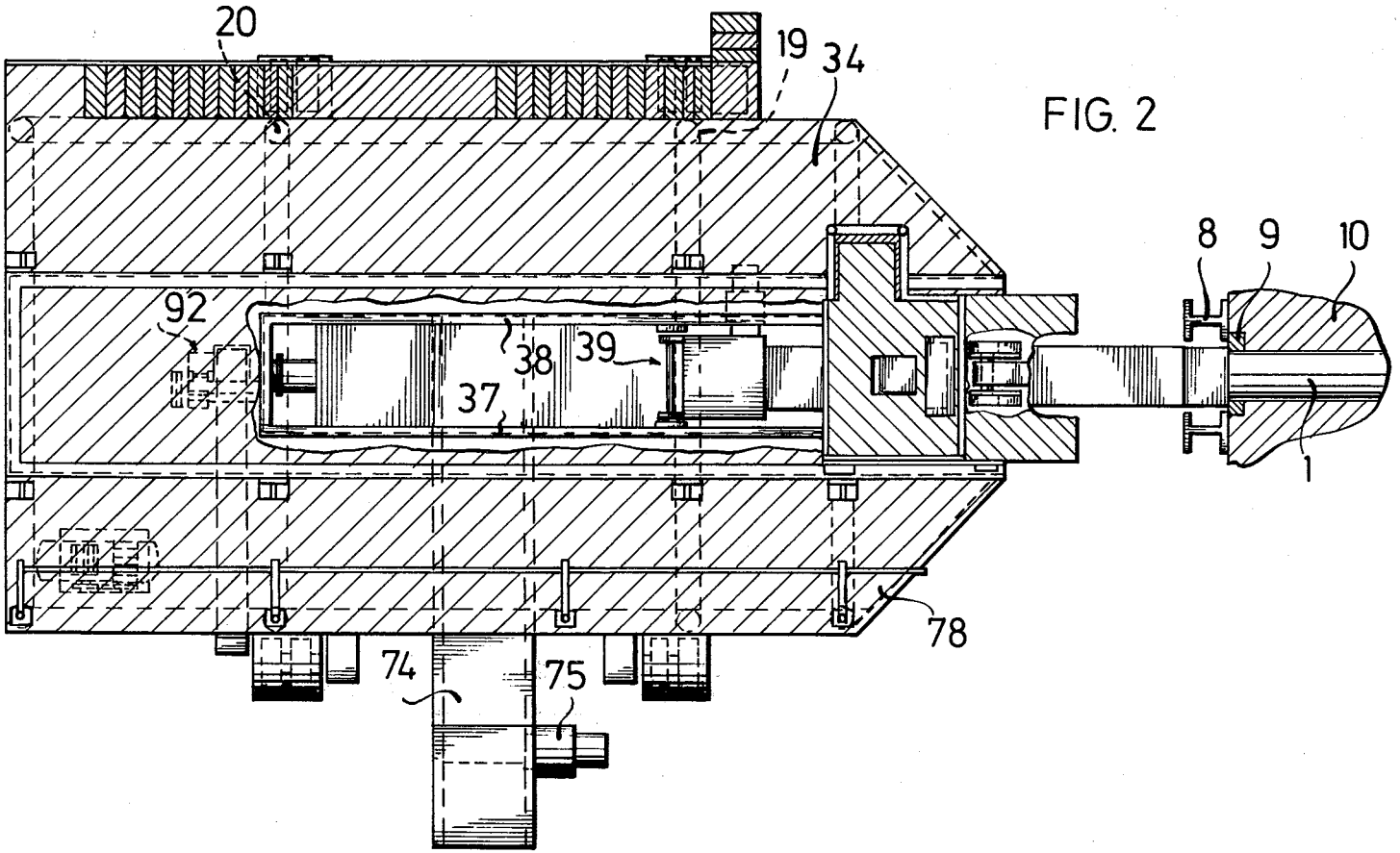
FIG. 2 is fragmentary plan view of the subject matter of FIG. 1.
Figure 4:
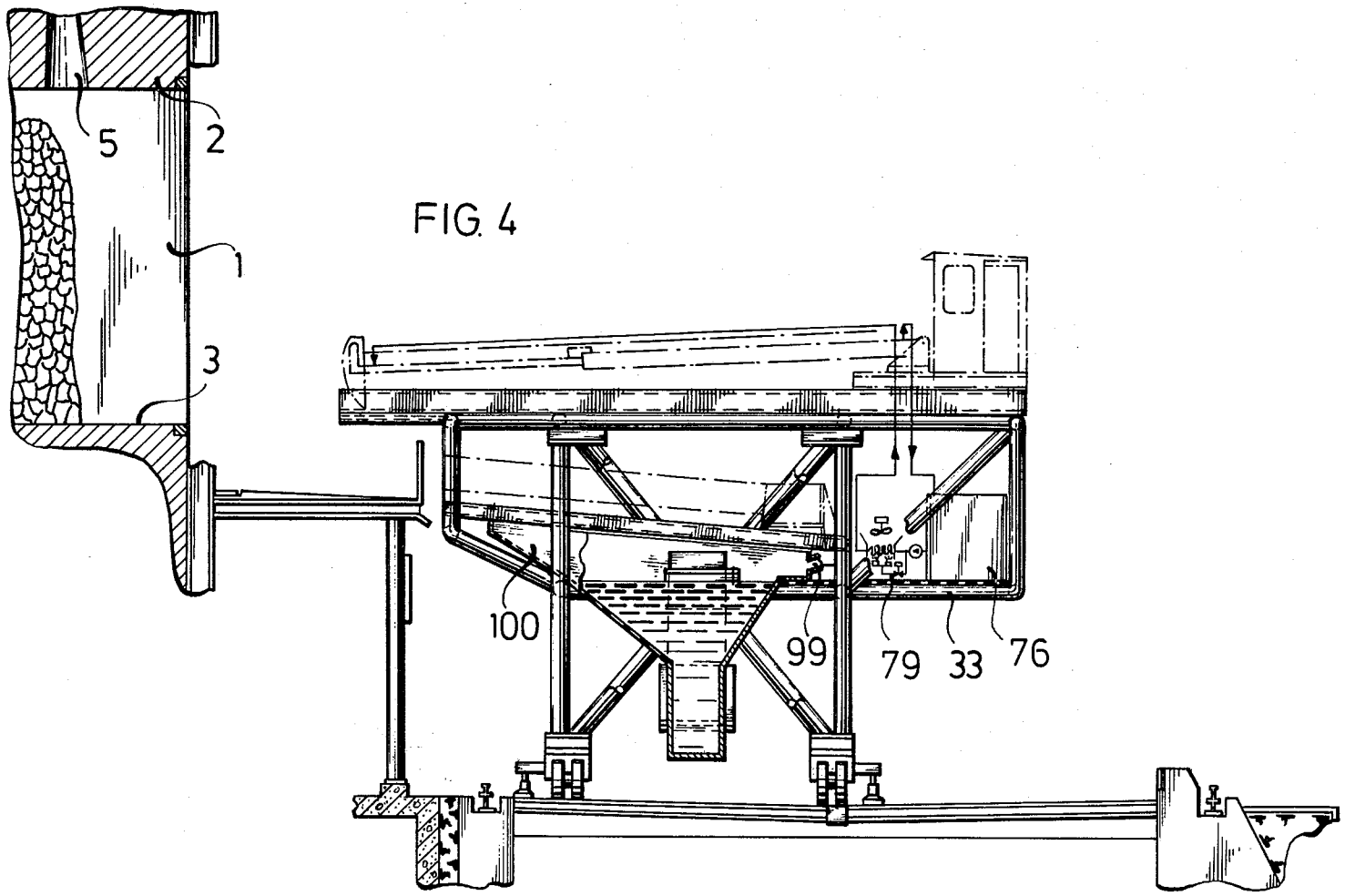
FIG. 4 a view of the device corresponding to FIG. 1 taken, however, on the machine side of the coke oven battery.

The oven chamber is indicated with the numeral 1 in FIGS. 1 and 4. The oven ceiling 2 shows a standpipe opening with the numeral 4 and filling holes with the numeral 5. The oven chamber has an oven floor 3. According to FIG. 1, the main passageway on the coke side of the battery is represented by 7. As the plan view according to FIG. 2 shows, each oven chamber has anchor posts 8 and a chamber frame 9. The hot walls are reproduced by 10.

Beneath the main corridor 7 on the coke side of the battery is located a track section for the non-disclosed coke quenching cars formed of the rails 12, 13 on a foundation 11. Between the rails 12, 13, travles apparatus 15 according to the present invention, which is further described in the following.

The apparatus 15 has an undercarriage that is formed of a gantry framework 16 with vertical posts 17 and 18 (see FIG. 1) and 19 and 20 (see FIG. 2) and braces, of which several are represented in FIG. 1 by 22 and 23. The gantry carries on its posts running gear 25 supported with vertical axes of rotation in bogies 24, said running gear being formed according to the disclosed exemplary embodiment of a plurality of rubber tired wheels 26, 27. The running gears are identically constructed. Their wheels are driven with hydraulic motors 28 supplied through a not-disclosed diesel hydraulic drive, which is installed on the gantry. An extendable support 29 with a corresponding base plate 30 is arranged on each running gear 25. It is thus possible to reliably support the device and to release the wheels as soon as it has attained its correct work position.

On the gantry 16 are located the necessary staircases, for example 31 and 32, that respectively serve as access to an intermediate gallery 33 and for the connection of the intermediate gallery 33 with a platform 34. The intermediate gallery 33 and the platform 34 are provided with the necessary railings as shown by 35. Additionally, the construction of the gantry serves for the mounting of protection devices against the effects of heat and steam.

Under the upper surface of the upper platform 34 are located bars 37, 38 that together form the rails for a driven carriage 39. The carriage carries the stationary part of a turntable 40, a part of which, rotatable about a vertical axis, includes a cabin 41, which surrounds a control stand 42, before which is placed a seat 43 for the operator. The carriage is in the direction of the double arrow 44, and therewith in the direction of the oven axis, transportable in both directions. Through the turntable a rotation in the horizontal plane is possible. This is used for a boom 45, that is mounted, on its end 46 in an operating link 47 arranged on the carriage that has a horizontal axis of rotation. By means of a swivel drive formed of one or more piston drives 48, that on the one hand are supported by 49 on the turntable and on the other hand by 50 on the underside of the boom, the boom can be additionally swivelled in a vertical plane.

This boom is acccording to the disclosed exemplary embodiment of three parts and is formed accordingly of an intermediate boom, the base boom 46' and the end boom 46'' telescoped in this. The booms are hollow formed and possess a cooling means supply according to the arrows 95, 96, as well as a cooling means return according to the arrows 97, 98. According to the illustration of FIG. 3 the cooling means comprises water that is supplied to the base boom through a supply connection 51 and is carried of out to the base boom through a discharge connection 52 in correspondence with the arrows 53 and 54. The telescoping apparatus generally indicated with 55 serves thus to connect the base boom, the intermediate boom, and the end boom and to connect through corresponding fittings 56, 57 the end boom 46'' with the associated cooling means.

An end section 58 positioned on the free end of boom 45 of the boom is bent upwardly and carries there a mounting head for a scraper and scooper device, for a working platform, and if necessary for manipulation tongs. In FIG. 1 the mechanism of the boom 45 is shown with a scoop combination 60. The scoop link 61 is fastened on the mounting head 59 through a link; the scoop combination is actuated through a thrust rod 62 from a thrust piston drive 63, that is supported on the base boom with a bracket 64 that it remains outside of the oven chamber when the carriage 39 is located in its forward end position.

Beneath the platform is located an intermediate conveyor 66 with a delivery chute 67 that can be installed on the oven floor 3. This conveyor 66 is located beneath a covering 68 that serves as heat protection and emission protection and can be retracted sufficiently far in the gantry that the apparatus 15 can move along the oven battery without colliding with the main passageway. The conveyor thus serves to supply incandescent coke originating out of oven chamber 1 to a coke collecting container 70, that is supported in the gantry. A sprayer 71 serves for the suppression of dust, smoke and steam, when the incandescent coke is supplied in the part 72 of the coke receiving container filled with water. The walls of the coke receiving container 70 converge downwardly, so that the coke can fall by itself on the inner part of a discharge conveyor 72 whose drive is indicated by 75 and that therefore serves to discharge the quenched coke in a suitable place. On the intermediate gallery is located a water supply container 76 for the aforesaid cooling means and a cooling device for the cooling means circuit 79 that has already been described in connection with FIG. 3. Additionally are mounted on the intermediate gallery a compressor, the already mentioned hydraulic station, a generator, a pump station, a fuel tank for the diesel machine, the sediment container and cooling devices for the pressure air and hydraulic oil.

Figure 3A:
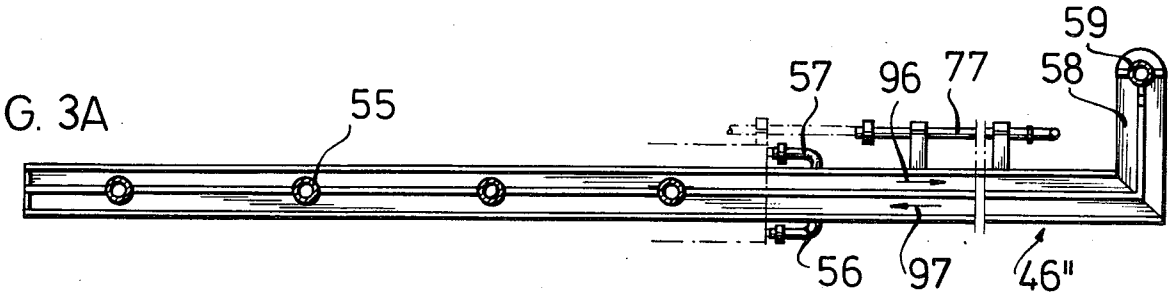
FIGS. 3A and 3B side views of elements of the boom of the machine which finds use with the apparatus according to FIG. 1.
Figure 3B:
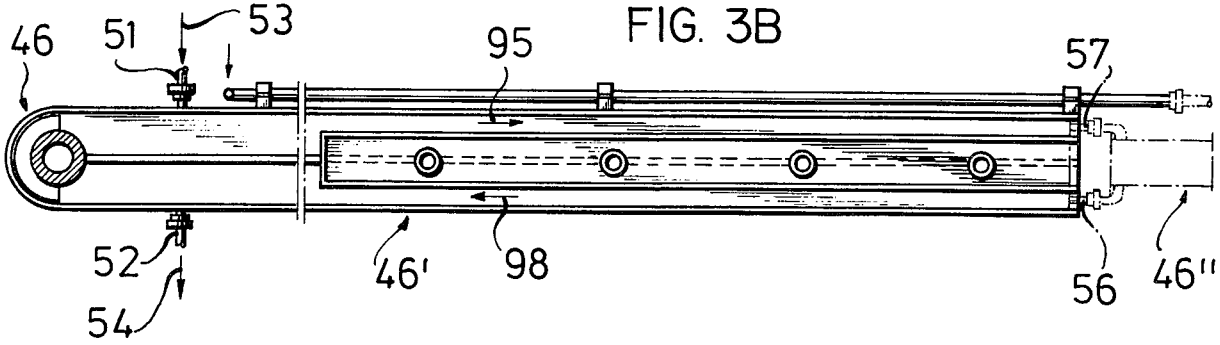

As is further explained below, the boom can also serve for the mounting of a service apparatus that is reproduced by 77 in FIG. 3. Besides that are involved different tools that can be laid down on the upper platform, as at 78.

Figure 5:
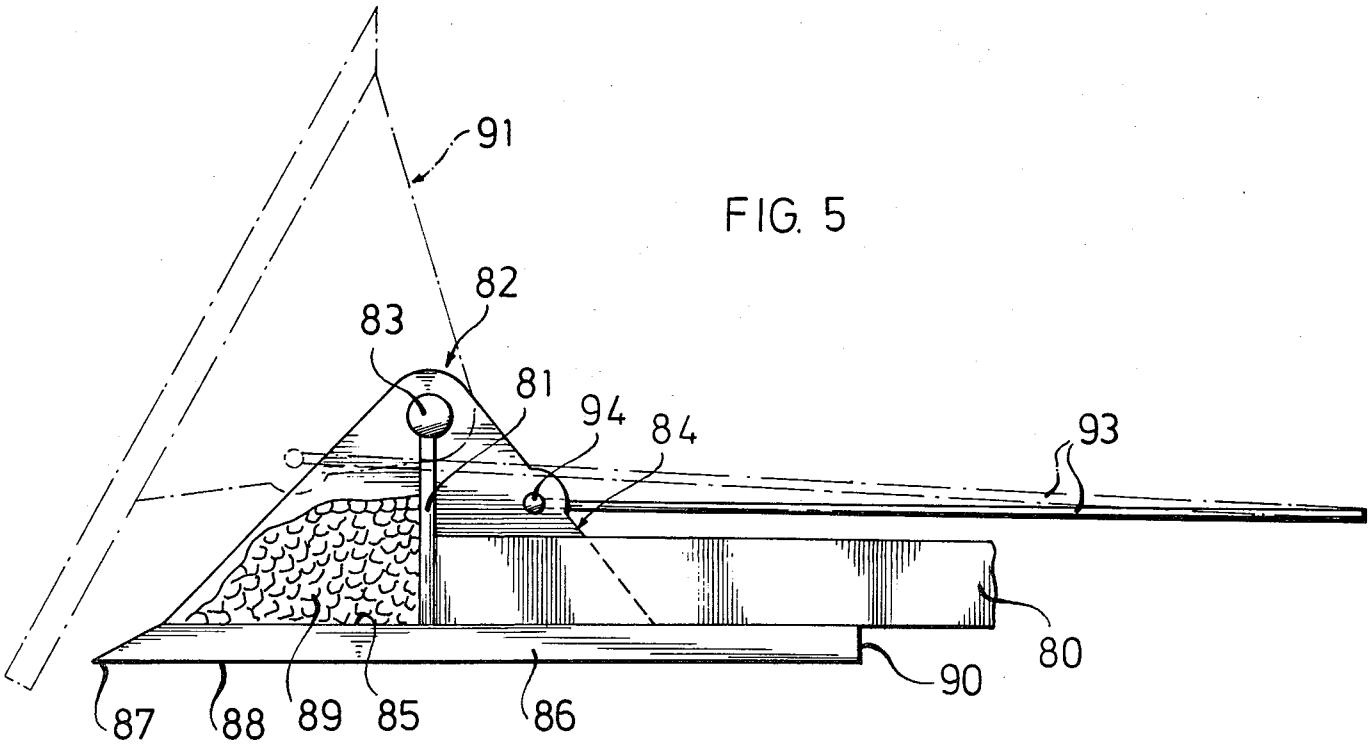
FIG. 5 schematically an exemplary embodiment of the combination of a scoop and scraper device of the inventive combination for the removal of the coke from each oven chamber.

According to FIG. 5, a swivel joint 82 is fastened on a plate 81 arranged orthogonally to the end of the boom schematically indicated by 80. The hinge pin 83 of the swivel link sits somewhat in the vertex of the triangular mounting plate 84 whose base is connected by 85 with a further plate 86. This plate 86 has a cutting edge 87 as the termination of its forward part and serves with its section 88 between the plate 81 and the cutting edge 87 as scoop (see the scoop filling indicated by 89). The rearward part between the plate 81 and the rear edge 90 serves as a scraper in the construction of the combination which in the dashed lines is reproduced by 91. The thus required movement energy is delivered from a thrust rod 93 which is mounted through a pivot link 94 on bracket plate 84.

In the following, the individual functions of the described apparatus will be explained;

1. Removal of an Operating Difficulty Through Packed Coke Charge In the Oven Chamber.

With a packed oven, with which however no incandescent coal is found in the transfer trough of the coking mass transport car, the coking mass transport car is moved initially to the side. Thereafter the device 15 is moved in front of the oven chamber and there aligned. As soon as this occurs the referred to supports 29 are extended through which the apparatus is stabilized. The required manipulations for the removal of the incandescent coke from the oven chamber are controlled from the control stand 42. The operator is thereby not exposed to any kind of danger through subsiding incandescent coke, heating effects or emissions. The coke scraped out with the scoop combination 60 passes through the intermediate conveyor 66 to the described spray apparatus and from there to the coke collection container element. By means of the discharge conveyor 74 can the quenched coke be discharged in the not disclosed mobile container. Emissions of the gas and dust forming type are made harmless through a vacuum apparatus with combined dust separation. The connection of such apparatus results among other things through the feed pipes 99 located in the covering hood 100 of the receiving container 70.

The scoop combination can carry out a simple thrust motion and thereby serve as a scoop as well as a scraper device.

The coke can be carried from the oven floor 3 by means of the scoop and emptied in the conveyor 66. The static forces are carried by the supports. Thus at maximum boom length the stability of the gantry is also guaranteed. The movement of the scoop combination is complemented through the movement of carriage 39 that can be moved through a drum device 92 (FIG. 2) with reversing apparatus. With such a winch apparatus it is possible to pull or push the carriage with the maximum force, independently of the rolling friction.

2. Operating Difficulties Through Packed Coke Charge Partially in the Oven Chamber, Partially in the Coking Mass Transport Car.

The apparatus 15 is with such operating trouble immediately and purposefully employed. The coking mass transport car remains stopped in the respective position in front of the oven. The necessary manipulation from control center 42 of the apparatus is effected, whereby initially only the incandescent coke is removed out of the coking mass guide. After that occurs, the coking mass transport guide car is able to travel without difficulties to the side. The removal of the incandescent coke out of the oven chamber ensues in the same way as described above under 1.

3. Packed Oven Filling.

It can happen that the oven chamber must be scraped from the machine side (FIG. 4). With an interrupted pressing out process caused through difficulty in the oven passage, this is almost always necessary, because thereby the head of the coking mass is damaged. A new pressing process can then be initiated, when the loose coke is so far removed out of the oven chamber that the pressure head can be applied in a forceful manner to the coking mass.

With large capacity ovens, this work has heretofore been carried out manually only with great exertion because in such cases the coking mass extends almost always too far in the oven chamber. The apparatus 15 can by contrast very simply and sufficiently rapidly prepare the coking mass with the necessary apparatuses that are adapted to the particular operational circumstances, so that a new pressing can be initiated. That is indicated in FIG. 4.

4. Repairs on the Ceramic Material.

In order to guarantee a trouble free pressing operation, a continuous maintenance of the ceramic oven parts is absolutely necessary. As a rule, this work is carried out manually. The repairs are, in the main, not very durable because after locating the area in need of repair, the repair material can be applied only incompletely and also not rapidly enough.

The apparatus 15 uses its boom 45 for the mounting of the repair tools and can, at the same time, fix the area to be repaired. Thus it is possible to carry out the indicated repair rapidly and permanently independently of the location of the area to be repaired with a minimum of personnel and repair material. The control of the processes results from the control center 42, from which viewing of the damaged area can be undertaken in a program controlled manner with an optical observation, for example, laser device in combination with a mini-processer. The entire repair program including the interchangeable tools comprises for example the following processes.

Overhead maintenance work through spraying of materials.

Equalization of the repair locations with scraping and knife devices;

Welding of the brick surface defects and open brick joints;

Filling of the oven floor material and insertion of individual bricks in the wall bond.

5. Optical Inspection of the Oven Walls, Oven Ceiling and Oven Floor.

For the routine supervision of the oven walls, oven floors, and oven ceilings, optical checks, at predetermined time intervals, are necessary. These are determined from the machine and coke side through inspection and assessment from colored gradations. Such processes yield however no relevant results.

With the apparatus 15, the boom 46″ can be employed for the mounting of television or infrared cameras, permitting the undertaking of the desired specific wall, ceiling, and oven floor examinations. Damages can be so rapidly detected and the repairs undertaken in proper time, contributing to a greater usability of the coke oven and longer service life.

6. Desired Severance of Graphite Type Deposits in the Oven Chamber Space, Standpipe Openings and Filling Holes.

With charges of highly volatile coals, over heatings in the gas collecting space, not optimally filling height in the oven chamber and short coking times, graphite type deposits in the region in the gas collection space, the standpipe mouth, the stand pipe, and filling holes are unavoidable. These crusts are very difficult to remove because, after a predetermined time span, they are hard as stone.

Heretofore, devices mounted on the pressure head of the coke pressing out machine, such as air sprinklers or scraping devices, have usually brought unsatisfactory results. Also mechanical devices for the removal of the deposits in the filling holes and stand pipes are not satisfactory. When these deposits attain a predetermined magnitude, manual removal of them has been heretofore unavoidable.

With the apparatus 15, the removal of the deposits can be carried out rapidly and without danger from control panel 42 through impact breaking devices, for example, air lances, that are mounted on the boom 45. That has value, in particular, for the removal of the deposits in the region of the rise pipe mouth in the lower portions of the filling holes that cannot be heretofore treated from a mechanical apparatus.

7. Use of Manipulation Tongs.

Apparatus 15 can mount a universal removable manipulation tong on the upper part of the boom. With this device one is in the position to control gripping movements which resemble a hand movement, at inaccessible locations in the hot oven chamber parts from the control station. By coordination with the optical distance control such work processes as removal of damaged bricks, insertion of new bricks, or insertion of fallen out heating plugs can be controlled simply and without problems. Also, in locations so difficult to reach at present, that repairs in the chamber walls are carried out by putting out of operation the oven unit including the associated neighboring ovens, through reduction of the heating flue temperatures, the chamber walls are shielded with insulating material or reflectors and the repairs undertaken in the oven chamber at the face. This is rather substantial part of the necessary work expenditure. Beyond that damage on the oven chambers through the cooling and heating occurs.

8. Mobile Repair Platform.

The boom 46″ can be provided with a repair platform that is operated from the control stand. Thus is avoided the burdensome displacement and securement of the work platform, that heretofore had to be erected in the main passageway. Beyond that the boom 45 can be used as a lifting means.

We claim:

1. Apparatus for servicing coke ovens in a battery, each coke oven having a floor and the battery having a pusher machine side and a coke side, said apparatus comprising:

a gantry having a plurality of vertical supports, each with a controllable and individually driven trackless running gear for moving said gantry along either side of the coke oven battery;

a boom machine mounted on said gantry and movable with respect thereto in a direction transverse to the direction of movement of the gantry along the battery;

a boom having one end mounted on said boom machine for horizontal rotation and vertical pivoting with respect to said boom machine, said boom having a connection head for a work implement at the other end;

a work implement for servicing the coke ovens coupled to said connection head;

an adjustable feed conveyor mounted in said gantry and extendable to the floor of the coke ovens for receiving material discharged from the coke ovens;

coke quenching means mounted in said gantry for receiving material from said feed conveyor;

receiving means mounted in said gantry for receiving material from said coke quenching means; and a discharge conveyor coupled to said receiving means for discharging the material from said servicing apparatus.

2. The apparatus according to claim 1 wherein said work implement comprises a scoop-scraper device for removing coke from the coke ovens.

3. The apparatus of claim 2 wherein said scoop-scraper device includes a plate, the forward part of which serves as a scoop when said device is in a first position, the rearward part of which serves as a scraper when said device is in a second position, said plate having bracket means for pivotal connection to said boom connection head, said boom containing push rod means coupled to said device for moving it between said first and second positions.

4. The apparatus of claim 3 wherein said push rod means is formed of a heat resistant material.

5. The apparatus of claim 1 wherein said gantry has an upper platform containing rails and wherein said boom machine has an undercarriage mounted on said rails and incorporating a boom rotating mechanism.

6. The apparatus of claim 1 wherein said coke quenching means has a suction hood coupled to airborne particle removal apparatus.

7. The apparatus of claim 1 wherein said boom is an extendable boom formed of a plurality of sections movable with respect to each other, said boom containing means for operating said work implement and means for circulating coolant to said work implement.

8. The apparatus of claim 1 wherein said work implement comprises camera means for examining the interior of the coke ovens.

9. The apparatus of claim 1 wherein the coke oven has stand pipe openings and filler holes susceptible to the deposit of graphite materials and wherein said work implement comprises means for removing such deposits.

10. The apparatus of claim 9 wherein said work implement comprises at least one of impact devices, breaking devices, and air lances.

11. The apparatus of claim 1 wherein said work implement is a manipulatable tong for repair work in the coke ovens.

12. The apparatus of claim 1 wherein said work implement comprises a work platform.

13. The apparatus of claim 1 wherein said gantry mounts a prime mover, a hydraulic power station, and a coolant supply means for said servicing apparatus.

* * * * *